US007514191B2

(12) United States Patent
Yanus et al.

(10) Patent No.: US 7,514,191 B2
(45) Date of Patent: Apr. 7, 2009

(54) IMAGING MEMBER

(75) Inventors: John F. Yanus, Webster, NY (US); Markus Silvestri, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 268 days.

(21) Appl. No.: 11/557,532

(22) Filed: Nov. 8, 2006

(65) Prior Publication Data

US 2007/0254223 A1 Nov. 1, 2007

Related U.S. Application Data

(63) Continuation-in-part of application No. 11/487,887, filed on Jul. 17, 2006.

(60) Provisional application No. 60/795,044, filed on Apr. 26, 2006.

(51) Int. Cl.
*G03G 5/047* (2006.01)

(52) U.S. Cl. ..... 430/58.75; 430/59.4; 430/59.5; 430/123.43

(58) Field of Classification Search ..... 430/58.75, 430/59.4, 59.5, 123.43
See application file for complete search history.

(56) References Cited

U.S. PATENT DOCUMENTS

| | | | | |
|---|---|---|---|---|
| 3,121,006 | A | 2/1964 | Middleton et al. | |
| 4,273,846 | A * | 6/1981 | Pai et al. | 430/58.75 |
| 4,286,033 | A | 8/1981 | Neyhart et al. | |
| 4,291,110 | A | 9/1981 | Lee | |
| 4,338,387 | A | 7/1982 | Hewitt | |
| 4,587,189 | A | 5/1986 | Hor et al. | |
| 4,664,995 | A | 5/1987 | Horgan et al. | |
| 5,604,064 | A * | 2/1997 | Nukada et al. | 430/58.65 |
| 7,005,222 | B2 | 2/2006 | Horgan et al. | |
| 7,166,397 | B2 * | 1/2007 | Mishra et al. | 430/58.8 |

* cited by examiner

*Primary Examiner*—John L Goodrow
(74) *Attorney, Agent, or Firm*—Eugene O. Palazzo; Fay Sharpe LLP

(57) ABSTRACT

An imaging member is disclosed with a charge transport layer comprising a dimethyl terphenyl diamine having the structure of Formula (I):

Formula (I)

wherein n is an integer from 0 to about 18. The resulting imaging member has enhanced performance properties.

24 Claims, 3 Drawing Sheets

IMAGING MEMBER

PRIORITY APPLICATIONS

This application is a continuation-in-part of U.S. patent application Ser. No. 11/487,887, filed Jul. 17, 2006, and titled "IMAGING MEMBER", which is fully incorporated by reference herein. That application in turn claims priority to U.S. Provisional Application Ser. No. 60/795,044, filed Apr. 26, 2006, which is also fully incorporated by reference herein.

BACKGROUND

The present disclosure, in various exemplary embodiments, relates generally to electrophotographic imaging members and, more specifically, to layered photoreceptor structures having a charge transport layer comprising certain terphenyl diamines.

Electrophotographic imaging members, i.e. photoreceptors, typically include a photoconductive layer formed on an electrically conductive substrate. The photoconductive layer is an insulator in the dark so that electric charges can be retained on its surface. Upon exposure to light, the charge is dissipated.

An electrostatic latent image is formed on the photoreceptor by first uniformly depositing an electric charge over the surface of the photoconductive layer by one of the many known means in the art. The photoconductive layer functions as a charge storage capacitor with charge on its free surface and an equal charge of opposite polarity on the conductive substrate. A light image is then projected onto the photoconductive layer. The portions of the layer that are not exposed to light retain their surface charge. After development of the latent image with toner particles to form a toner image, the toner image is usually transferred to a receiving substrate, such as paper.

A photoreceptor usually comprises a supporting substrate, a charge generating layer, and a charge transport layer ("CTL"). For example, in a negative charging system, the photoconductive imaging member may comprise a supporting substrate, an electrically conductive layer, an optional charge blocking layer, an optional adhesive layer, a charge generating layer, a charge transport layer, and an optional protective or overcoat layer. In various embodiments, the charge transport layer may be one single layer or may comprise multiple layers having the same or different compositions at the same or different concentrations.

The charge transport layer usually comprises, at a minimum, charge transporting molecules ("CTMs") dissolved in a polymer binder resin, the layer being substantially non-absorbing in a spectral region of intended use, for example, visible light, while also being active in that the injection of photogenerated charges from the charge generating layer can be accomplished. Further, the charge transport layer allows for the efficient transport of charges to the free surface of the transport layer.

When a charge is generated in the charge generating layer, it should be efficiently injected into the charge transport molecule in the charge transport layer. The charge should also be transported across the charge transport layer in a short time, more specifically in a time period shorter than the time duration between the exposing and developing steps in an imaging device. The transit time across the charge transport layer is determined by the charge carrier mobility in the charge transport layer. The charge carrier mobility is the velocity per unit field and has dimensions of $cm^2/V$ sec. The charge carrier mobility is generally a function of the structure of the charge transport molecule, the concentration of the charge transport molecule in the charge transport layer, and the electrically "inactive" binder polymer in which the charge transport molecule is dispersed.

The charge carrier mobility must be high enough to move the charges injected into the charge transport layer during the exposure step across the charge transport layer during the time interval between the exposure step and the development step. To achieve maximum discharge or sensitivity for a fixed exposure, the photoinjected charges must transit the transport layer before the imagewise exposed region of the photoreceptor arrives at the development station. To the extent the carriers are still in transit when the exposed segment of the photoreceptor arrives at the development station, the discharge is reduced and hence the contrast potentials available for development are also reduced. The transit time of charges across the charge transport layer and charge carrier mobility are related to each other by the expression transit time=(transport layer thickness)$^2$/(mobility×applied voltage).

It is known in the art to increase the concentration of the charge transport molecule dissolved or molecularly dispersed in the binder. However, phase separation or crystallization sets an upper limit to the concentration of the transport molecules that can be dispersed in a binder. One way of increasing the solubility of the charge transport molecule is to attach long alkyl groups onto the transport molecules. However, these alkyl groups are "inactive" and do not transport charge. For a given concentration of charge transport molecule, a larger side chain can actually reduce the charge carrier mobility. A second factor that reduces the charge carrier mobility is the dipole content of the charge transport molecule in their side groups as well as that of the binder in which the molecules are dispersed.

One charge transport molecule known in the art is N,N'-diphenyl-N,N'-bis(3-methylphenyl)-[1,1'-biphenyl]-4,4'-diamine (TPD). TPD has a zero-field mobility of about $1.38\times10^{-6}$ $cm^2/V$ sec at a concentration of 40 weight percent in polycarbonate. Zero-field mobility $\mu_0$ is the mobility extrapolated down to vanishing fields, i.e., the field E in $\mu=\mu_0 \exp(\beta E^{0.5})$ is set to zero. In general the field dependence expressed by $\beta$ is weak.

There continues to be a need for an improved imaging member having a charge transport layer with high carrier charge mobility. Such an imaging member would allow for increases in the speed of imaging devices such as printers and copiers.

CROSS REFERENCE TO RELATED PATENTS AND APPLICATIONS

In U.S. Pat. No. 4,273,846, to Pai et al., the disclosure of which is fully incorporated herein by reference, an imaging member having a charge transport layer containing a terphenyl diamine is described.

U.S. patent application Ser. No. 09/976,061 to Yanus et al, filed 15 Oct. 2001, discloses aryldiamine charge transport molecules having more than 3 phenyl groups between the nitrogen atoms of the aryldiamine. This disclosure is also fully incorporated herein by reference.

U.S. patent application Ser. No. 10/736,864 to Horgan et al, filed 16 Dec. 2003; U.S. Pat. No. 7,005,222, to Horgan et al., issued Feb. 28, 2006; and U.S. patent application Ser. No. 10/744,369 to Mishra et al, filed 23 Dec. 2003, the disclosures of which are fully incorporated herein by reference, disclose a plurality of charge transport layers which may contain a terphenyl diamine.

SUMMARY

Disclosed herein, in various embodiments, are photoconductive imaging members having a charge transport layer comprising a charge transport molecule or component selected from certain terphenyl diamines. Examples of these terphenyl diamines are N,N'-bis(3,4-dimethylphenyl)-N,N'-bis[4-(alkyl)phenyl]-[p-terphenyl]-4,4"-diamine, having the structure of Formula (I):

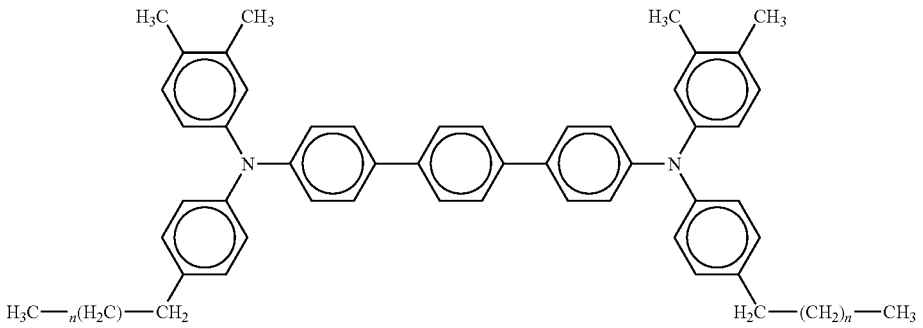

Formula (I)

wherein n is an integer from 0 to about 18. The photoconductive imaging members possess a number of the advantages illustrated herein including enhanced performance properties.

In specific embodiments, the terphenyl diamine is N,N'-bis(3,4-dimethylphenyl)-N,N'-bis[4-(n-butyl)phenyl]-[p-terphenyl]-4,4"-diamine, having the structure of Formula (II):

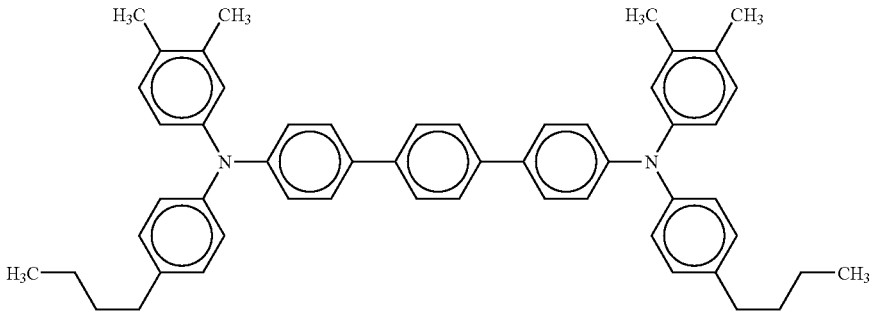

Formula (II)

Also disclosed herein are methods of making such imaging members and methods of imaging utilizing such imaging members. The imaging members have improved carrier charge mobility and allow for imaging and printing at increased speeds.

In a further embodiment, the imaging member has a charge generating layer and a charge transport layer comprising a polymer binder resin and one of the terphenyl diamines noted above. The imaging member may be of a flexible belt design or a rigid drum design.

In another embodiment, the imaging member has a charge generating layer and a charge transport layer comprising two layers, a bottom layer and a top layer. The bottom layer and top layer are adjacent to each other and the bottom layer is adjacent to the charge generating layer. Both the bottom layer and the top layer comprise a polymer binder resin and a terphenyl diamine selected from the group described above. The terphenyl diamine in each layer may be the same or different. The concentration of the terphenyl diamine in the bottom layer is greater than the concentration of the terphenyl diamine in the top layer.

In still a further embodiment, a flexible imaging member is provided comprising a charge generating layer, and overlaid thereon and in contiguous contact therewith, a charge transport layer having two or more layers. The layers comprise one or more of the terphenyl diamines shown above, wherein the concentration of the terphenyl diamine is greater in the charge transport layer in contiguous contact with the charge generating layer.

In another embodiment, the imaging member has a charge generating layer and a charge transport layer comprising two layers, a bottom or first layer and a top or second layer. The bottom layer and top layer are adjacent to each other and the bottom layer is adjacent to the charge generating layer. Both the bottom layer and the top layer comprise a polymer binder resin and a terphenyl diamine from the group described above. The terphenyl diamine in each layer may be the same or different. The bottom layer comprises from about 30 weight percent to about 50 weight percent of its terphenyl diamine and the top layer comprises from about 0 weight percent to about 45 weight percent of its terphenyl diamine, the top layer having a lower concentration of its terphenyl diamine than the bottom layer.

These and other non-limiting features or characteristics of the present disclosure will be further described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
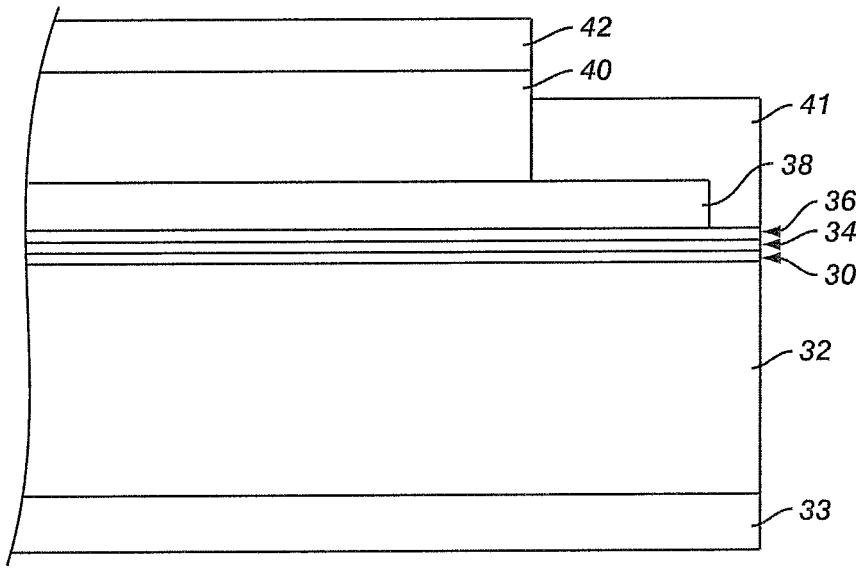
FIG. 1 is a cross-sectional view of an exemplary embodiment of an imaging member having a single charge transport layer.

The imaging members disclosed herein can be used in a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are also useful in color xerographic applications, particularly high-speed color copying and printing processes.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the Figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

An exemplary embodiment of the imaging member of the present disclosure is illustrated in FIG. 1. The substrate 32 has an optional conductive layer 30. An optional hole blocking layer 34 can also be applied, as well as an optional adhesive layer 36. The charge generating layer 38 is located between the optional adhesive layer 36 and the charge transport layer 40. An optional ground strip layer 41 operatively connects the charge generating layer 38 and the charge transport layer 40 to the conductive layer 30. An opposite anti-curl back layer 33 may be applied to the side of the substrate 32 opposite from the electrically active layers. An optional overcoat layer 42 may be placed upon the charge transport layer 40.

Figure 2:
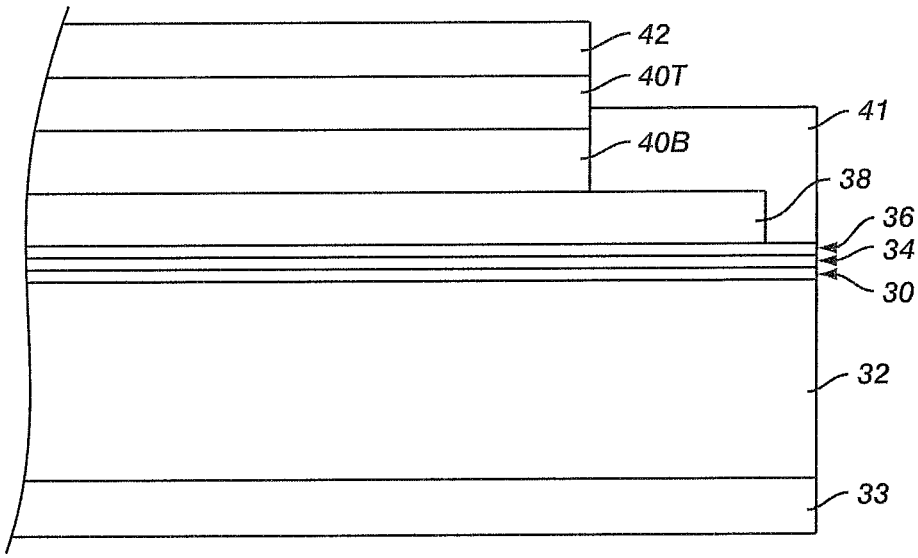
FIG. 2 is a cross-sectional view of another exemplary embodiment in which the imaging member has a dual-layer charge transport layer.

In another exemplary embodiment as illustrated in FIG. 2, the charge transport layer comprises dual layers 40B and 40T. The dual layers 40B and 40T may have the same or different compositions. In other embodiments, a plurality of charge transport layers can be utilized, although not shown in the figures.

The charge transport layer 40 of FIG. 1 comprises certain specific charge transport materials which are capable of supporting the injection of photogenerated holes or electrons from the charge generating layer 38 and allowing their transport through the charge transport layer to selectively discharge the surface charge on the imaging member surface. The charge transport layer, in conjunction with the charge generating layer, should also be an insulator to the extent that an electrostatic charge placed on the charge transport layer is not conducted in the absence of illumination. It should also exhibit negligible, if any, discharge when exposed to a wavelength of light useful in xerography, e.g., about 4000 Angstroms to about 9000 Angstroms. This ensures that when the imaging member is exposed, most of the incident radiation is used in the charge generating layer beneath it to efficiently produce photogenerated charges.

The charge transport layer of the present disclosure comprises a specific charge transport molecule which supports the injection and transport of photogenerated holes or electrons. The charge transport molecule has the molecular structure shown in Formula (I):

Formula (I)

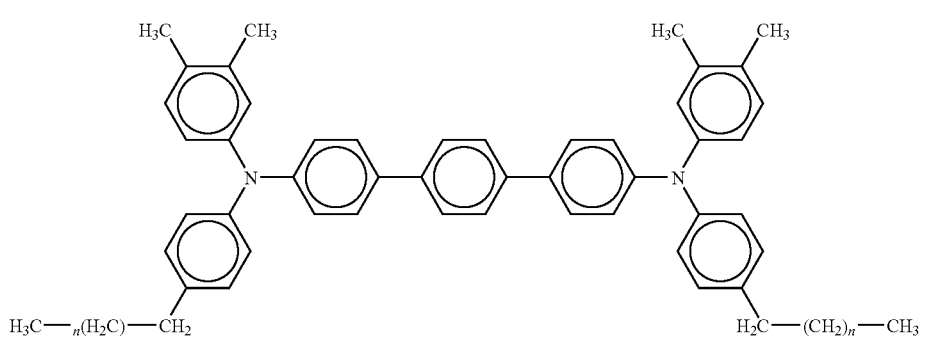

wherein n is an integer from 0 to about 18.

The full name for this charge transport molecule is N,N'-bis(3,4-dimethylphenyl)-N,N'-bis[4-(alkyl)phenyl]-[p-terphenyl]-4,4"-diamine. In this disclosure, the charge transport molecules of this formula will be referred to as "dimethyl terphenyl" or "diMeTer".

In specific embodiments, the terphenyl diamine is N,N'-bis(3,4-dimethylphenyl)-N,N'-bis[4-(n-butyl)phenyl]-[p-terphenyl]-4,4"-diamine, having the structure of Formula (II):

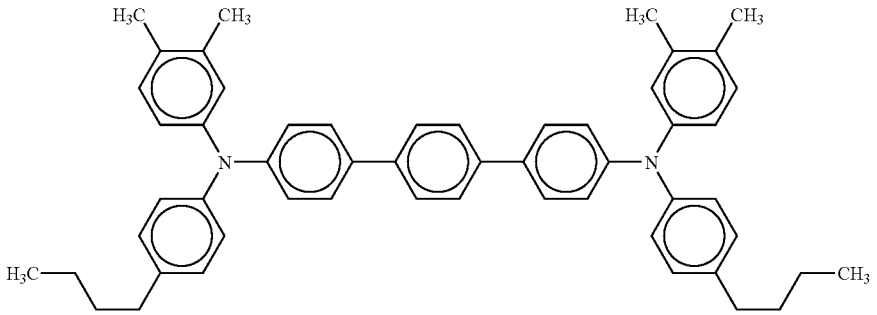

Formula (II)

In this disclosure, this specific charge transport molecule will be referred to as "dimethyl butyl terphenyl" or "DBT".

If desired, the charge transport layer may also comprise other charge transport molecules. For example, the charge transport layer may contain other triarylamines such as TPD, tri-p-tolylamine, 1,1-bis(4-di-p-tolylaminophenyl) cyclohexane, and other similar triarylamines. The additional charge transport molecules may, e.g., help minimize background voltage. In particular, embodiments where the dimethyl terphenyl compound is mixed with TPD are contemplated. The present disclosure also contemplates mixtures of different dimethyl terphenyl diamines, especially mixtures containing DBT. However, in specific embodiments, the charge transport layer contains only DBT.

The charge transport layer also comprises a polymer binder resin in which the charge transport molecule(s) or component(s) is dispersed. The resin should be substantially soluble in a number of solvents, like methylene chloride or other solvent so that the charge transport layer can be coated onto the imaging member. Typical binder resins soluble in methylene chloride include polycarbonate resin, polyvinylcarbazole, polyester, polyarylate, polyacrylate, polyether, polysulfone, polystyrene, polyamide, and the like. Molecular weights of the binder resin can vary from, for example, about 20,000 to about 300,000, including about 150,000.

Polycarbonate resins having a weight average molecular weight Mw, of from about 20,000 to about 250,000 are suitable for use, and in embodiments from about 50,000 to about 120,000, may be used. The electrically inactive resin material may include poly(4,4'-dipropylidene-diphenylene carbonate) with a weight average molecular weight ($M_w$) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company. Resins known as PC-Z®, available from Mitsubishi Gas Chemical Corporation, may also be used. In specific embodiments, MAKROLON, available from Bayer Chemical Company, and having a molecular weight of from about 70,000 to about 200,000, is used. Methylene chloride is used as a solvent in the charge transport layer coating mixture for its low boiling point and the ability to dissolve charge transport layer coating mixture components to form a charge transport layer coating solution.

The charge transport layer of the present disclosure in embodiments comprises from about 20 weight percent to about 60 weight percent of the charge transport molecule(s) and from about 40 weight percent to about 75 weight percent by weight of the polymer binder resin, both by total weight of the charge transport layer. In specific embodiments, the charge transport layer comprises from about 40 weight percent to about 50 weight percent of the charge transport molecule(s) and from about 50 weight percent to about 60 weight percent of the polymer binder resin.

In embodiments where the charge transport layer comprises dual or multiple layers, the layers may differ in the charge transport molecule(s) selected, the polymer binder resin selected, both or neither. However, generally the charge transport molecule(s) and polymer binder resin are the same and the dual or multiple layers differ only in the concentration of the charge transport molecule(s). More specifically, the top layer has a lower concentration of charge transport molecule(s) than the bottom layer. In further embodiments, the bottom layer comprises from about 30 weight percent to about 50 weight percent of the charge transport molecule(s) and the top layer comprises from about 0 weight percent to about 45 weight percent of the charge transport molecule(s), wherein the weight percentage is based on the weight of the respective layer, not the total charge transport layer. In specific embodiments, the bottom layer comprises from about 30 weight percent to about 50 weight percent of the charge transport molecule(s) and the top layer comprises from about 20 weight percent to about 45 weight percent of the charge transport molecule(s). In further specific embodiments, the bottom layer comprises about 50 weight percent of all charge transport molecules and the top layer comprises about 40 weight percent of all charge transport molecules. Generally, the concentration of the selected dimethyl terphenyl molecule is greater in the bottom layer than the top layer. If the bottom layer has a different dimethyl terphenyl molecule than that of the top layer, the concentration of the dimethyl terphenyl molecule in the bottom layer should greater than or equal to the concentration of the dimethyl terphenyl molecule in the top layer.

In embodiments having a single charge transport layer, the charge transport molecule(s) is substantially homogenously dispersed throughout the polymer binder. In embodiments where the charge transport layer comprises dual layers, the charge transport molecule(s) in the bottom layer is substantially homogeneously dispersed throughout the bottom layer and the charge transport molecule(s) in the top layer is substantially homogeneously dispersed throughout the top layer.

Generally, the thickness of the charge transport layer is from about 2 to about 100 micrometers, including from about 20 micrometers to about 60 micrometers, but thicknesses outside these ranges can also be used. In general, the ratio of the thickness of the charge transport layer to the charge generating layer is in embodiments from about 2:1 to 200:1 and in some instances from about 2:1 to about 400:1. In specific embodiments, the charge transport layer is from about 10 micrometers to about 40 micrometers thick.

Any suitable technique may be used to mix and apply the charge transport layer onto the charge generating layer. Generally, the components of the charge transport layer are mixed into an organic solvent to form a coating solution. Typical solvents comprise methylene chloride, toluene, tetrahydrofuran, and the like. Typical application techniques include extrusion die coating, spraying, roll coating, wire wound rod coating, and the like. Drying of the coating solution may be effected by any suitable conventional technique such as oven drying, infra red radiation drying, air drying and the like. When the charge transport layer comprises dual or multiple layers, each layer is solution coated, then completely dried at elevated temperatures prior to the application of the next layer.

If desired, other known components may be added the charge transport layer or, if there are dual or multiple layers, to all of the layers. Such components may include antioxidants, such as a hindered phenol, leveling agents, surfactants, and light shock resisting or reducing agents. Particle dispersions may increase the mechanical strength of the charge transport layer as well.

The imaging member of the present disclosure may comprise a substrate 32, optional anti-curl back layer 33, an optional conductive layer 30 if the substrate is not adequately conductive, optional hole blocking layer 34, optional adhesive layer 36, charge generating layer 38, charge transport layer 40, an optional ground strip layer 41, and an optional overcoat layer 42. The remaining layers will now be described with reference to FIGS. 1-2.

The substrate support 32 provides support for all layers of the imaging member. Its thickness depends on numerous factors, including mechanical strength, flexibility, and economical considerations; the substrate for a flexible belt may, for example, be from about 50 micrometers to about 150 micrometers thick, provided there are no adverse effects on the final electrophotographic imaging device. The substrate support is not soluble in any of the solvents used in each coating layer solution, is optically transparent, and is thermally stable up to a high temperature of about 150° C. A typical substrate support is a biaxially oriented polyethylene terephthalate. Another suitable substrate material is a biaxially oriented polyethylene naphthalate, having a thermal contraction coefficient ranging from about $1\times10^{-5}$/° C. to about $3\times10^{-5}$/° C. and a Young's Modulus of from about $5\times10^{5}$ psi to about $7\times10^{5}$ psi. However, other polymers are suitable for use as substrate supports. The substrate support may also be made of a conductive material, such as aluminum, chromium, nickel, brass and the like. Again, the substrate support may flexible or rigid, seamed or seamless, and have any configuration, such as a plate, drum, scroll, belt, and the like.

The optional conductive layer 30 is present when the substrate support 32 is not itself conductive. It may vary in thickness depending on the optical transparency and flexibility desired for the electrophotographic imaging member. Accordingly, when a flexible electrophotographic imaging belt is desired, the thickness of the conductive layer may be from about 20 Angstrom units to about 750 Angstrom units, and more specifically from about 50 Angstrom units to about 200 Angstrom units for an optimum combination of electrical conductivity, flexibility and light transmission. The conductive layer may be formed on the substrate by any suitable coating technique, such as a vacuum depositing or sputtering technique. Typical metals suitable for use as the conductive layer include aluminum, zirconium, niobium, tantalum, vanadium, hafnium, titanium, nickel, stainless steel, chromium, tungsten, molybdenum, and the like.

The optional hole blocking layer 34 forms an effective barrier to hole injection from the adjacent conductive layer into the charge generating layer. Examples of hole blocking layer materials include gamma amino propyl triethoxyl silane, zinc oxide, titanium oxide, silica, polyvinyl butyral, phenolic resins, and the like. Hole blocking layers of nitrogen containing siloxanes or nitrogen containing titanium compounds are disclosed, for example, in U.S. Pat. No. 4,291,110, U.S. Pat. No. 4,338,387, U.S. Pat. No. 4,286,033 and U.S. Pat. No. 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of from about 0.2 to about 2 micrometers.

An optional adhesive layer 36 may be applied to the hole blocking layer. Any suitable adhesive layer may be utilized. Any adhesive layer employed should be continuous and, more specifically, have a dry thickness from about 200 micrometers to about 900 micrometers and, even more specifically, from about 400 micrometers to about 700 micrometers. Any suitable solvent or solvent mixtures may be employed to form a coating solution for the adhesive layer. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited coating may be effected by any suitable conventional technique such as oven drying, infra red radiation drying, air drying, and the like.

Any suitable charge generating layer 38 may be applied which can thereafter be coated over with a contiguous charge transport layer. The charge generating layer generally comprises a charge generating material and a film-forming polymer binder resin. Charge generating materials such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be appropriate because of their sensitivity to white light. Vanadyl phthalocyanine, metal free phthalocyanine and tellurium alloys are also useful because these materials provide the additional benefit of being sensitive to infrared light. Other charge generating materials include quinacridones, dibromo anthanthrone pigments, benzimidazole perylene, substituted 2,4-diamino-triazines, polynuclear aromatic quinones, and the like. Benzimidazole perylene compositions are well known and described, for example, in U.S. Pat. No. 4,587,189, the entire disclosure thereof being incorporated herein by reference. Other suitable charge generating materials known in the art may also be utilized, if desired. The charge generating materials selected should be sensitive to activating radiation having a wavelength from about 600 to about 700 nm during the imagewise radiation exposure step in an electrophotographic imaging process to form an electrostatic latent image. In specific embodiments, the charge generating material is hydroxygallium phthalocyanine (OHGaPC) or oxytitanium phthalocyanine (TiOPC).

Any suitable inactive film forming polymeric material may be employed as the binder in the charge generating layer 38, including those described, for example, in U.S. Pat. No. 3,121,006, the entire disclosure thereof being incorporated herein by reference. Typical organic polymer binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating material can be present in the polymer binder composition in various amounts. Generally, from about 5 to about 90 percent by volume of the charge generating material is dispersed in about 10 to about 95 percent by volume of the polymer binder, and more specifically from about 20 to about 50 percent by volume of the charge generating material is dispersed in about 50 to about 80 percent by volume of the polymer binder.

The charge generating layer generally ranges in thickness of from about 0.1 micrometer to about 5 micrometers, and more specifically has a thickness of from about 0.3 micrometer to about 3 micrometers. The charge generating layer thickness is related to binder content. Higher polymer binder content compositions generally require thicker layers for charge generation. Thickness outside these ranges can be selected in order to provide sufficient charge generation.

An optional anti-curl back coating 33 can be applied to the back side of the substrate support 32 (which is the side opposite the side bearing the electrically active coating layers) in order to render flatness. Although the anti-curl back coating may include any electrically insulating or slightly conductive organic film forming polymer, it is usually the same polymer as used in the charge transport layer polymer binder. An anti-curl back coating from about 7 to about 30 micrometers in thickness is found to be adequately sufficient for balancing the curl and render imaging member flatness.

An electrophotographic imaging member may also include an optional ground strip layer 41. The ground strip layer comprises, for example, conductive particles dispersed in a film forming binder and may be applied to one edge of the photoreceptor to operatively connect charge transport layer 40, charge generating layer 38, and conductive layer 30 for electrical continuity during electrophotographic imaging process. The ground strip layer may comprise any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

An overcoat layer 42, if desired, may be utilized to provide imaging member surface protection as well as improve resistance to abrasion. Overcoat layers are known in the art. Generally, they serve a function of protecting the charge transport layer from mechanical wear and exposure to chemical contaminants.

The imaging member formed may have a rigid drum configuration or a flexible belt configuration. The belt can be either seamless or seamed. In this regard, the fabricated multilayered flexible photoreceptors of the present disclosure may be cut into rectangular sheets and converted into photoreceptor belts. The two opposite edges of each photoreceptor cut sheet are then brought together by overlapping and may be joined by any suitable means including ultrasonic welding, gluing, taping, stapling, and pressure and heat fusing to form a continuous imaging member seamed belt, sleeve, or cylinder. The prepared imaging member may then be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

The imaging members of the present disclosure may be used in imaging. This method comprises generating an electrostatic latent image on the imaging member. The latent image is then developed and transferred to a suitable substrate, such as paper. Processes of imaging, especially xerographic imaging and printing, including digital, are also encompassed by the present disclosure. More specifically, the layered photoconductive imaging members of the present development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

The present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Example 1

Preparation of N,N'-bis(3,4-dimethylphenyl)-N,N'-bis[4-(n-butyl)phenyl]-[p-terphenyl]-4,4"-diamine, or dimethyl butyl terphenyl (DBT)

A 250 ml three necked round bottom flask equipped with a mechanical stirrer and purged with argon was charged with 15.1 grams (0.06 moles) of 3,4-dimethylphenyl-[4-(n-butyl) phenyl]amine, 9.64 grams (0.02 moles) of 4,4"-diiodoterphenyl, 15 grams (0.11 moles) of potassium carbonate, 10 grams of copper bronze and 50 milliliters of $C_{13}$-$C_{15}$ aliphatic hydrocarbons, i.e. Isopar® M (Exxon Corp). The mixture was heated for 18 hours at 210° C. The product was isolated by the addition of 200 mls of Isopar® M and hot filtered to remove inorganic solids. The product crystallized out on cooling and was isolated by filtration. Treatment with alumina in hot hydrocarbons yielded substantially pure, about 99 percent N,N'-bis(3,4-dimethylphenyl)-N,N'-bis[4-(n-butyl)phenyl]-[p-terphenyl]-4,4"-diamine (DBT) in approximately 75% yield.

Example 2

Preparation of Imaging Member

An electrophotographic imaging member web stock was prepared by providing a 0.02 micrometer thick titanium layer coated on a biaxially oriented polyethylene naphthalate substrate (KADALEX, available from ICI Americas, Inc.) having a thickness of 3.5 mils (89 micrometers) and applying thereto, using a gravure coating technique and a solution containing 10 grams gamma aminopropyltriethoxysilane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with extrusion process to the blocking layer a wet coating containing 5 percent by weight based on the total weight of the solution of polyester adhesive (MOR-ESTER 49,000, available from Morton International, Inc.) in a 70:30 volume ratio mixture of tetrahydrofuran:cyclohexanone. The adhesive interface layer was allowed to dry for 5 minutes at 135° C. in a forced air oven. The resulting adhesive interface layer had a dry thickness of 0.065 micrometer The adhesive interface layer was thereafter coated with a charge generating layer. The charge generating layer dispersion was prepared by introducing 0.45 grams of LUPILON 200 (PC-Z 200) available from Mitsubishi Gas Chemical Corp and 50 ml of tetrahydrofuran into a 4 oz. glass bottle. To this solution were added 2.4 grams of hydroxygallium phthalocyanine and 300 grams of ⅛ inch (3.2 millimeter) diameter stainless steel shot. This mixture was then placed on a ball mill for 20 to 24 hours. Subsequently, 2.25 grams of PC-Z 200 was dissolved in 46.1 gm of tetrahydrofuran, then added to this OHGaPc slurry. This slurry was then placed on a shaker for 10 minutes. The resulting slurry was, thereafter, coated onto the adhesive interface by an extrusion application process to form a layer having a wet thickness of 0.25 mil. However, a strip about 10 mm wide along one edge of the substrate web bearing the blocking layer and the adhesive layer was deliberately left uncoated by any of the charge generating layer material to facilitate adequate electrical contact by the ground strip layer that is applied later. This charge generating layer was dried at 135° C. for 5 minutes in a forced air oven to form a dry charge generating layer having a thickness of 0.4 micrometer layer.

A charge transport layer coating solution was then prepared. In a one ounce bottle, 1.3 grams of MAKROLON was dissolved in 11 grams of methylene chloride. 0.87 grams of dimethyl butyl terphenyl (DBT) was stirred in until a complete solution was achieved. A charge transport layer was coated onto the charge generating layer using a 4 mil Bird bar. The layer was dried at 40-100° C. for 30 minutes in a forced air oven to yield a first imaging member having a charge transport layer that was 25 microns thick and contained 40 weight percent of dimethyl butyl terphenyl (DBT) and 60 weight percent MAKROLON.

Experimental Data

Figure 3:
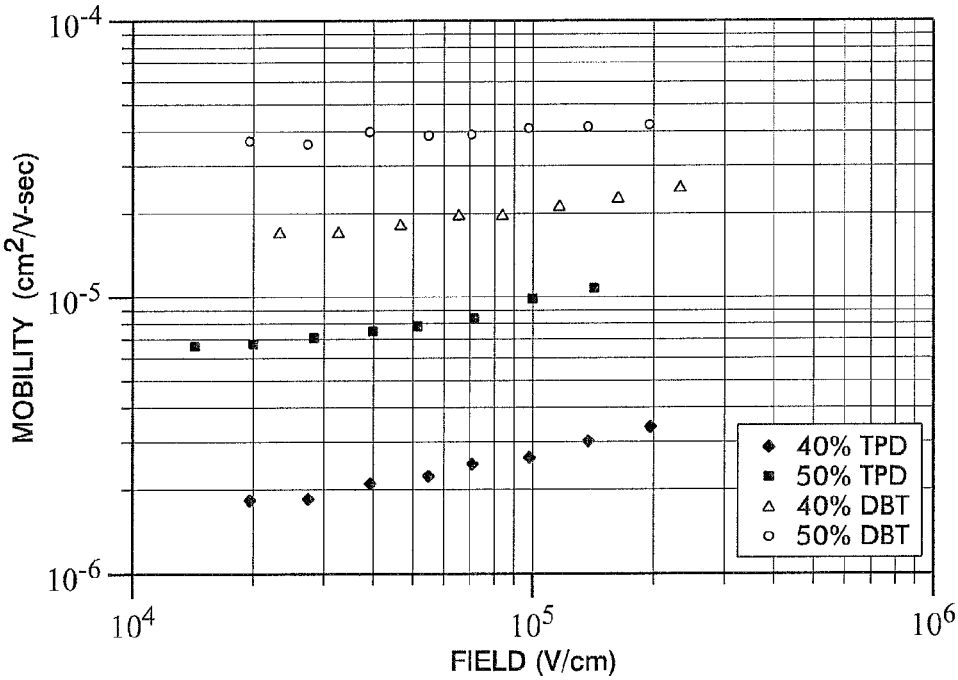
FIG. 3 is a graph showing the mobility vs. electric field strength of two exemplary embodiments of the present disclosure against two controls.

Four imaging members were provided with charge transport layers containing 40 weight percent TPD, 50 weight percent TPD, 40 weight percent dimethyl butyl terphenyl (DBT), and 50 weight percent dimethyl butyl terphenyl (DBT), respectively. The remaining weight percent of each imaging member was MAKROLON. The imaging members with TPD served as control. The imaging members were exposed to different electric fields and their mobilities were measured. The resulting data is shown in Table 1 below and in FIG. 3, which is a graph of the results showing mobility vs. electric field strength.

TABLE 1

| | Sample ID | | | |
|---|---|---|---|---|
| | 40% TPD | 50% TPD | 40% DBT | 50% DBT |
| | Thickness of CTL (μm) | | | |
| | 25.5 | 35.2 | 21.5 | 25.6 |
| Bias (V) | Transit Time (ms) | Transit Time (ms) | Transit Time (ms) | Transit Time (ms) |
| 50 V | 70.70 | 37.50 | 5.44 | 3.56 |
| 70 V | 49.90 | 26.15 | 3.84 | 2.62 |
| 100 V | 30.75 | 17.35 | 2.52 | 1.66 |
| 140 V | 20.75 | 11.74 | 1.67 | 1.22 |
| 180 V | 14.54 | 8.78 | 1.30 | 0.94 |
| 250 V | 9.90 | 5.95 | 0.86 | 0.64 |
| 350 V | 6.19 | 3.60 | 0.58 | 0.45 |
| 500 V | 3.83 | 2.32 | 0.37 | 0.31 |

TABLE 1-continued

| | Sample ID | | | |
|---|---|---|---|---|
| | 40% TPD | 50% TPD | 40% DBT | 50% DBT |
| | Thickness of CTL (μm) | | | |
| | 25.5 | 35.2 | 21.5 | 25.6 |
| Bias (V) | Transit Time (ms) | Transit Time (ms) | Transit Time (ms) | Transit Time (ms) |
| Measured Zero Field Mobility $\mu_0$ ($cm^2/V$ s) | $1.38 \times 10^{-6}$ | $5.14 \times 10^{-6}$ | $1.42 \times 10^{-5}$ | $3.44 \times 10^{-5}$ |
| Field parameter $\beta$ in $\mu = \mu_0 \exp(\beta E^{0.5})$ ($(cm/V)^{0.5}$) | $2.09 \times 10^{-3}$ | $1.94 \times 10^{-3}$ | $1.18 \times 10^{-3}$ | $4.89 \times 10^{-4}$ |
| Activation energy from Arrhenius plot of the initial discharge speed (eV) | 376 | Not measured | 280 | Not measured |

The results of this test indicated that the dimethyl terphenyl compounds had higher mobility and lower activation energy at the same concentrations, compared to TPD. The DBT compounds were approximately 10 and 7 times faster than TPD at the two concentrations. Higher mobility has the advantage of faster transport. The lower the field parameter, the less undesirable electrostatic spreading and the less detrimental changes of the initial charge distribution of the charges in transit will take place. The activation energy governs the temperature dependence, and again, the lower, the better, since it makes the photoreceptor less susceptible to temperature variations in the environment.

Figure 4:
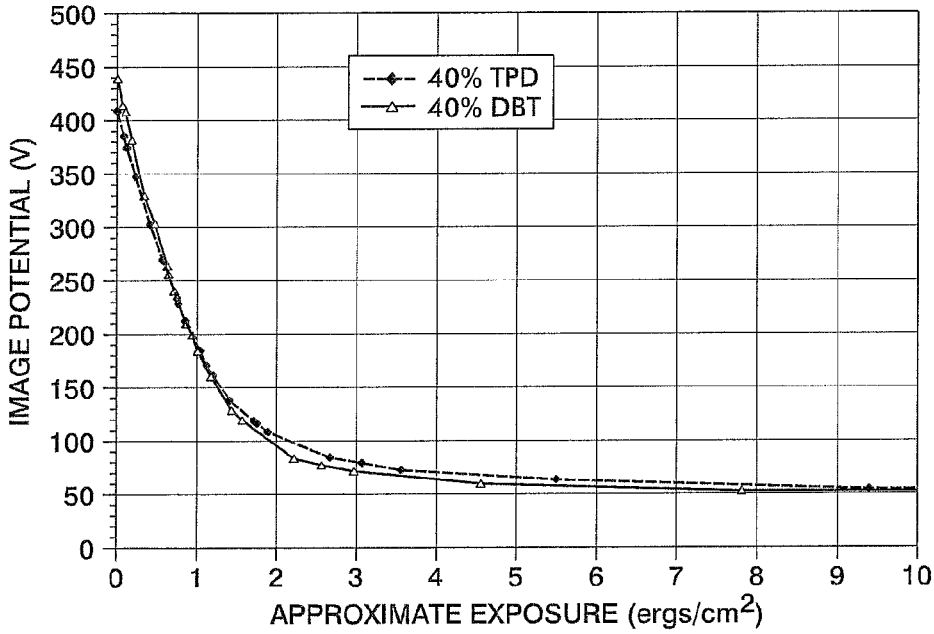
FIG. 4 is a PIDC graph of an exemplary embodiment of the present disclosure against a control.

Next, the xerographic electrical properties of two imaging members, 40% TPD and 40% DBT, were measured. Each member was charged and then discharged at various exposure values, to obtain a photoinduced discharge curve (PIDC) for each imaging member. The potentials were measured at 750 ms after exposure avoiding transient effects confounding photo-generation. The PIDCs are shown in FIG. 4. The fast transport of DBT does not adversely affect photosensitivity; the transport molecule and the photo-generation pigment are still well matched.

Figure 5:
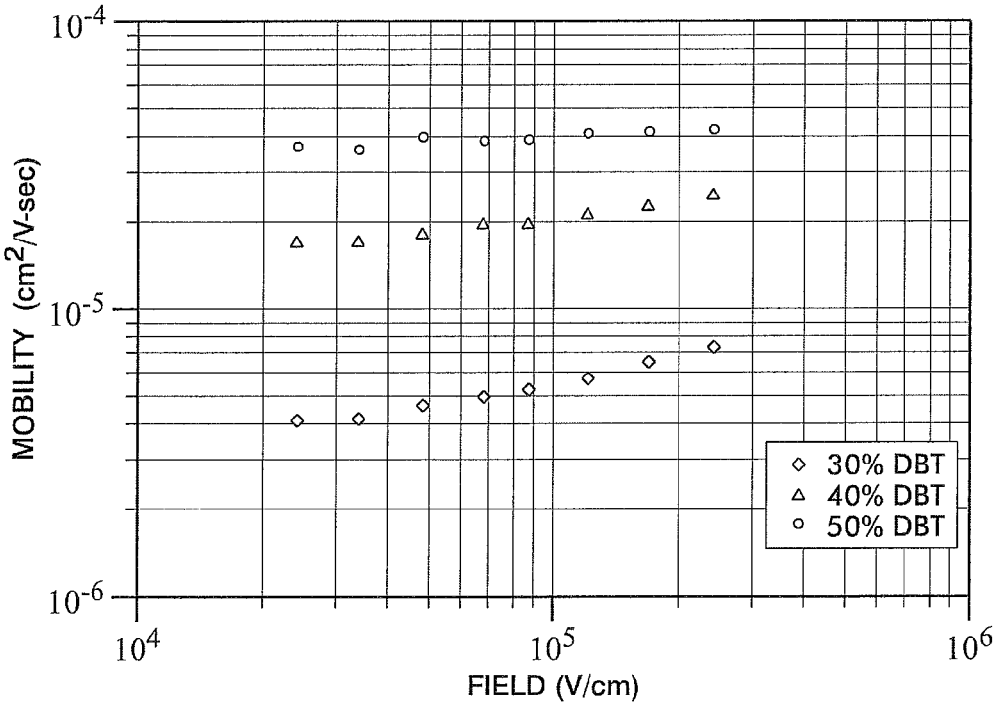
FIG. 5 is a graph showing the change in mobility with concentration of the charge transport molecule in exemplary embodiments of the present disclosure.

Three imaging members containing 30 weight percent, 40 weight percent, and 50 weight percent DBT in their respective charge transport layer were fabricated. These imaging members were exposed to different electric fields and their mobilities were measured. The results are shown in FIG. 5. As noted, mobility increased as the concentration of the charge transport molecule was increased.

Figure 6:
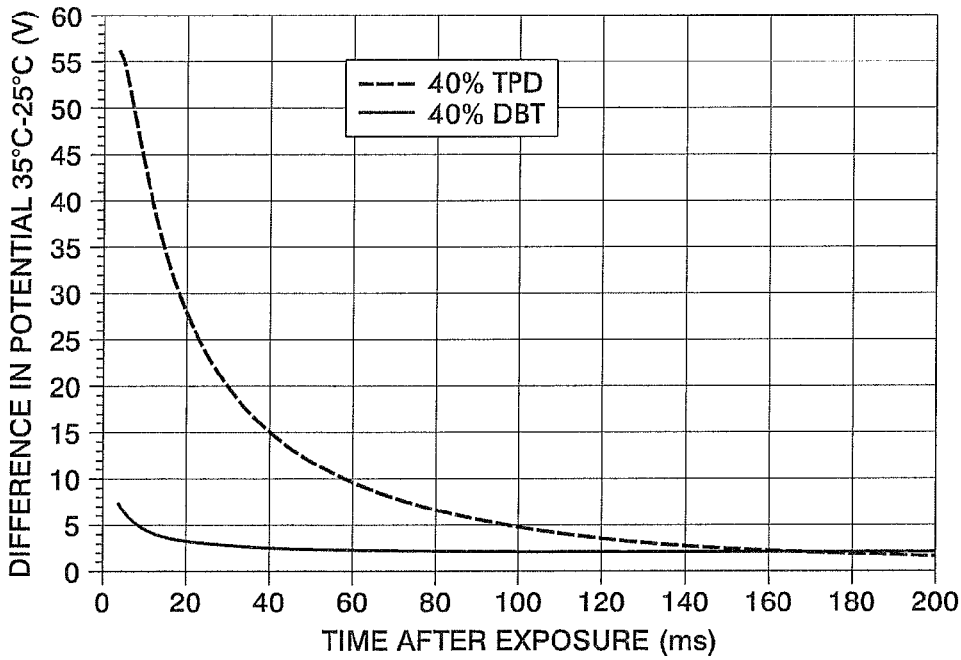
FIG. 6 is a graph showing the difference in potential as a function of time after an exposure of two temperatures for an exemplary embodiment of the present disclosure.

An imaging member with 40 weight percent DBT in the charge transport layer and an imaging member with 40 weight percent TPD were fabricated. They were exposed at 35° C. and at 25° C. and the voltage remaining on the photoreceptor after exposure was measured as a function of time. Normally, the voltage remaining on the photoreceptor after exposure for a given exposure-to-measurement time varies with the temperature. However, this detrimental effect is minimal in DBT for the relevant times. This can be very useful in a printing machine, which can operate in a broad temperature range (e.g. from 15-40° C.), because the latent image on the photoconductor is less susceptible to local temperature variation across the photoconductor within the print engine. Unlike TPD, all charges transited the DBT charge transport layer at the relevant temperatures in similar times, making the photoreceptor insensitive to temperature variations. FIG. 6 shows the results of this experiment. The difference in the potentials at 25° C. and 35° C. were plotted against time. DBT showed only small changes in the discharge potential in contrast to TPD.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member comprising at least one charge transport layer comprising a polymer binder resin and a terphenyl diamine charge transport component, wherein the terphenyl diamine charge transport component is an N,N'-bis(3,4-dimethylphenyl)-N,N'-bis[4-(alkyl)phenyl]-[p-terphenyl]-4,4"-diamine of Formula (I):

Formula (I)

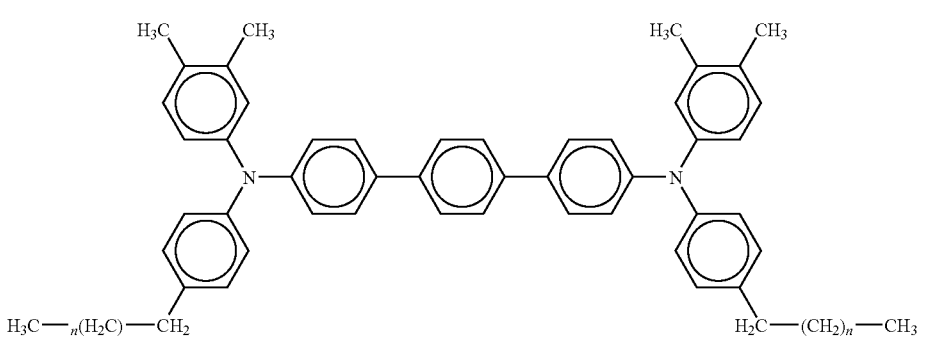

wherein n is an integer from 0 to about 18.

2. The imaging member of claim 1, wherein the terphenyl diamine charge transport component is N,N'-bis(3,4-dimethylphenyl)-N,N'-bis[4-(n-butyl)phenyl]-[p-terphenyl]-4,4"-diamine.

3. The imaging member of claim 1, wherein the at least one charge transport layer comprises the terphenyl diamine charge transport component and a second charge transport component.

4. The imaging member of claim 3 wherein the terphenyl diamine charge transport component and the second charge transport component are different N,N'-bis(methylphenyl)-N,N'-bis[4-(alkyl)phenyl]-[p-terphenyl]-4,4"-diamines.

5. The imaging member of claim 3, wherein the second charge transport component is a triarylamine of at least one selected from the group consisting of N,N'-diphenyl-N,N'-bis(3-methylphenyl)-[1,1'-biphenyl]-4,4'-diamine; tri-p-tolylamine; and 1,1-bis(4-di-p-tolylaminophenyl) cyclohexane.

6. The imaging member of claim 1, wherein the terphenyl diamine charge transport component comprises from about 20 weight percent to about 60 weight percent of the charge transport layer, based on the total weight of the charge transport layer.

7. The imaging member of claim 1, wherein the terphenyl diamine charge transport component comprises from about 40 weight percent to about 50 weight percent of the charge transport layer.

8. The imaging member of claim 1, further comprising a charge generating layer and a total of two charge transport layers, a first charge transport layer contacting the charge generating layer, and a second charge transport layer over the second charge transport layer, said second charge transport layer containing a lower concentration of the terphenyl diamine charge transport component than said first charge transport layer.

9. The imaging member of claim 8, wherein the first charge transport layer comprises from about 30 weight percent to about 50 weight percent of charge transport components; and wherein the second charge transport layer comprises from about 0 weight percent to about 45 weight percent of charge transport components, wherein the weight percentage is based on the total weight of each respective layer.

10. The imaging member of claim 8, wherein the terphenyl diamine charge transport component is contained substantially completely within the first charge transport layer.

11. The imaging member of claim 8, wherein the first charge transport layer comprises from about 30 weight percent to about 50 weight percent of charge transport components; and wherein the second charge transport layer comprises from about 20 weight percent to about 45 weight percent of charge transport components, wherein the weight percentage is based on the weight of each respective layer.

12. The imaging member of claim 8, wherein the charge generating layer is comprised of inorganic or organic components.

13. The imaging member of claim 8, wherein the charge generating layer comprises metal phthalocyanine, metal free phthalocyanines, selenium, selenium alloys, hydroxygallium phthalocyanines, halogallium phthalocyanines, titanyl phthalocyanines or mixture thereof.

14. The imaging member of claim 8, wherein the charge generating layer comprises a charge generating material selected from the group consisting of hydroxygallium phthalocyanine and oxytitanium phthalocyanine.

15. The imaging member of claim 1, wherein the binder is selected from the group consisting of polyesters, polyvinyl butyrals, polycarbonates, polystyrene, and polyvinyl formats.

16. The imaging member of claim 15, wherein the binder is a polycarbonate selected from the group consisting of poly(4,4'-isopropyliene diphenyl carbonate), poly(4 4diphenyl-1,1'-cyclohexane carbonate), or a polymer blend thereof.

17. The imaging member of claim 1, wherein the total thickness of the charge transport layer is from about 2 micrometers to about 100 micrometers.

18. The imaging member of claim 17, wherein the total thickness of the charge transport layer is from about 20 micrometers to about 60 micrometers.

19. The imaging member of claim 1, further comprising an overcoat layer which is in contact with the charge transport layer.

20. An imaging member comprising a substrate, an optional conductive layer, an optional hole blocking layer, an optional adhesive layer, a charge generating layer, and a charge transport layer, wherein the charge transport layer comprises a bottom layer and a top layer;

wherein the bottom and top layers each comprise a polymer binder resin and a dimethyl terphenyl diamine which is an N,N'-bis(3,4-dimethylphenyl)-N,N'-bis[4-(alkyl)phenyl]-[p-terphenyl]-4,4"-diamine, having the structure of Formula (I):

Formula (I)

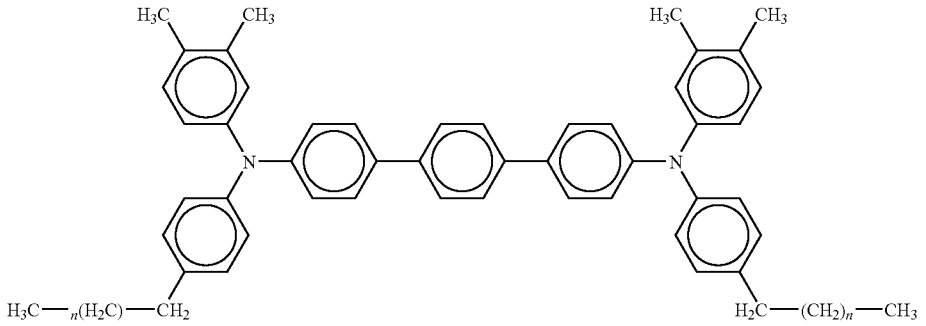

Wherein n is an integer from 0 to about 18; and wherein the bottom layer comprises from about 30 weight percent to about 50 weight percent of the terphenyl diamine and the top layer comprises from about 0 weight percent to about 45 weight percent of the terphenyl diamine the top layer having a lower concentration of the terphenyl diamine than the bottom layer.

21. The imaging member of claim 20, wherein the top layer comprises from about 20 weight percent to about 45 weight percent of the terphenyl diamine.

22. The imaging member of claim 20, wherein the terphenyl diamine is N,N'-bis(3,4-dimethylphenyl)-N,N'-bis[4-(n-butyl)phenyl]-[p-terphenyl]-4,4"-diamine.

23. The imaging member of claim 20, further comprising an overcoat layer in contact with the charge transport layer.

24. A method of imaging, comprising:

generating an electrostatic latent image on an imaging member;

developing the latent image; and transferring the developed electrostatic image to a suitable substrate;

wherein the imaging member has a charge transport layer comprising a terphenyl diamine having the structure of Formula (I):

Formula (I)

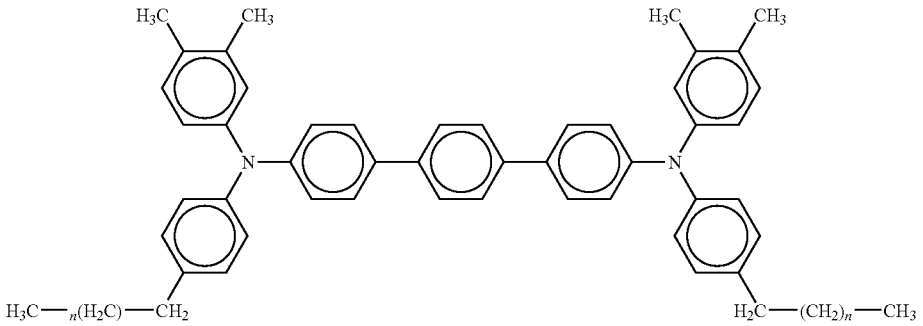

wherein n is an integer from 0 to about 18.

* * * * *